US008087914B1

(12) United States Patent
Soderstrom

(10) Patent No.: US 8,087,914 B1
(45) Date of Patent: Jan. 3, 2012

(54) POSITIVE DISPLACEMENT PUMP WITH IMPROVED ROTOR DESIGN

(76) Inventor: Harry Soderstrom, Marietta, GA (US)

( * ) Notice: Subject to any disclaimer, the term of this patent is extended or adjusted under 35 U.S.C. 154(b) by 495 days.

(21) Appl. No.: 12/414,179

(22) Filed: Mar. 30, 2009

(51) Int. Cl.
*F03C 2/00* (2006.01)
*F03C 4/00* (2006.01)
*F04C 18/00* (2006.01)

(52) U.S. Cl. ..... 418/206.5; 418/132; 418/206.1; 418/206.6

(58) Field of Classification Search ..... 418/131–132, 418/139, 206.1–206.6
See application file for complete search history.

(56) References Cited

U.S. PATENT DOCUMENTS 2,754,050 A * 7/1956 Wellington ..... 418/153
2,944,732 A * 7/1960 Lorenz ..... 418/206.5
4,764,098 A * 8/1988 Iwase et al. ..... 418/206.1
5,567,140 A * 10/1996 Dodd ..... 418/206.1
6,053,717 A * 4/2000 Dixon ..... 418/206.6
7,857,607 B2 * 12/2010 Bishop et al. ..... 418/206.1

FOREIGN PATENT DOCUMENTS

JP 60237189 A * 11/1985 ..... 418/206.5
JP 61123793 A * 6/1986 ..... 418/206.5
JP 06229385 A * 8/1994 ..... 418/206.5

* cited by examiner

*Primary Examiner* — Theresa Trieu
(74) *Attorney, Agent, or Firm* — Stephen J. Stark; Miller & Martin PLLC

(57) ABSTRACT

An improved positive displacement pump provides improved wear characteristics. Specifically, rotor pads are provided on faces relative to an internal portion of the rotor housing as it relates to an end wall and a rear side of a cover plate. The rotor pads preferably have at least one of anti-galling and/or anti-friction or anti-wear characteristics thereby providing improvements over the prior art. A central member is preferably provided so that pad replacement may be relatively easily performed in the field in clean in place operations.

19 Claims, 5 Drawing Sheets

POSITIVE DISPLACEMENT PUMP WITH IMPROVED ROTOR DESIGN

FIELD OF THE INVENTION

The present invention relates to a positive displacement pump having improved rotor construction, and more preferably to a lobe pump configuration having at least one improved surface which contacts the casing and/or end wall of the cavity in the rotor housing.

BACKGROUND OF THE INVENTION

Positive displacement pumps such as lobe pumps have been in existence for a number of years. They are used in a variety of industries such as the food industry, beverage industry, pharmaceutical industry, paper industry and other industries. They are a particularly attractive option in many industries as they can be highly efficient, reliable, resistant to corrosion and have excellent sanitary properties. They traditionally provide excellent clean in place (CIP) characteristics for such applications where the pumps are routinely taken apart and cleaned as it relates to cleaning the cavity, rotors and associated components.

Lobe pumps often offer continuous, intermittent or reversible flow. Their construction allows for flow to be relatively independent of changes in pressure. Output can therefore be relatively constant and continuous.

Lobe pumps operate by providing at least two rotors which are supported by parallel shafts: a drive shaft and a lay shaft. The lay shaft is driven by gearing of the drive shaft to the lay shaft in a gear box which is usually integrally connected to the casing having a rotor housing. Seals prevent an exchange of fluid from the rotor housing into the bearing housing. As the shafts turn, they are operably coupled to the rotors causing the rotors to turn. The rotors have cooperating lobes.

As the lobes mesh with one another, they create an expanding volume on the inlet side of the pump. Liquid or solid flows into the cavity and is trapped by the lobes as they rotate. The material travels around the interior of the casing and the pockets between the lobes and the casing while not passing between the lobes. Finally, the meshing of the lobes forces the liquid material out the outlet port under pressure. Various improvements have occurred over the years with lobe pumps. U.S. Pat. No. 6,053,717 shows wiper inserts which extend radially from the lobes.

U.S. Pat. No. 5,567,140 shows another improvement. In this design, a pump chamber is defined in the pump housing by opposed front and rear end walls which are perpendicular to the axes of the rotors and by arcuate side walls. The rotors are believed to make sealing contact with these surfaces and they gradually wear out thereby reducing the tightness of the seal and thus the pumping efficiency of the rotary lobe pump. In an effort to provide better seals, the rear end wall construction includes two removable wear plates. The arcuate side walls are also provided with removable wear plates. Although this is certainly one method to address wear, the applicant believes there is an additional and/or improved methods of addressing wear and providing improved positive displacement pumps.

SUMMARY OF THE INVENTION

It is a present object of the present invention to provide an improved positive displacement pump having an improved construction.

It is another object of the present invention to provide improved rotors and/or rotor to shaft connections for use with positive displacement pumps such as lobe pumps.

It is another object of the present invention to provide improved wear surfaces for use internal to the cavity where rotors rotate relative to a cover plate and an end wall in a positive displacement pump.

In accordance with the presently preferred embodiment of the present invention, a positive displacement pump, preferably a lobe pump, is provided having parallel shafts with rotors connected thereto. The rotors each have at least two lobes which mesh to pump material from an inlet to an outlet, it being understood that either inlet outlet can be used as either inlet or outlet by reversing the rotation direction of the shafts for a lobe pump.

The shafts are normally geared internal to a gear box and one of the shafts is normally externally driven by some type of motorized mechanism. The lateral faces of the rotors which face a front cover plate and an opposing end wall in the rotor housing are preferably provided with wear surfaces and more particularly with replaceable rotor pads. The rotor pads are preferably constructed to extend past a central support member at either end of the rotor for contact with both lateral faces. In a preferred embodiment, front and rear rotor pads are somewhat similarly constructed but may take on different designs in various embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
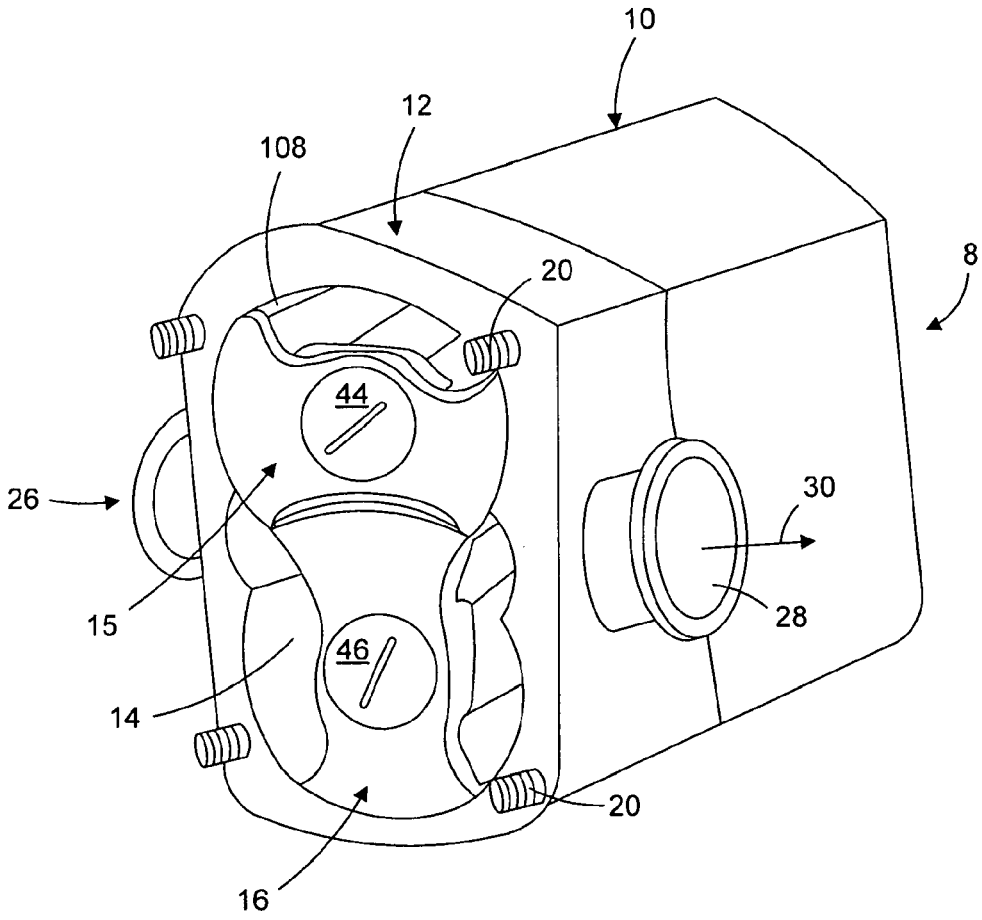
FIG. 1 is a top perspective view of a first presently preferred embodiment of a positive displacement pump with the cover plate removed.

In FIG. 1, the applicant shows pump 8 having a gear box 10 connected to a rotor housing 12. Rotor housing 12 is normally removably mounted at a front end of the gear box 10. The rotor housing 12 defines an internal cavity 14 where first and second rotors 15,16 are adapted for rotation in the pump cavity 14. A removable rotor cover or cover plate 18 closes the cavity 14 and is normally secured to the rotor housing 12 by way of a plurality of threaded studs 20 which extend through bores in the cover plate 18 and are secured to the housing 12 with nuts 21 which could be dome nuts, wing nuts or any other sizable type of nut. Of course, other connection mechanism could be utilized to retain the cover plate 18 to the rotor housing 12 in other embodiments.

A drive shaft 22 is illustrated parallel to a lay shaft 24. The first and second rotors 15,16 are operably coupled to the shafts 22,24 for respective rotation. Drive shaft 22 preferably extends outwardly of the gear box 10 such as could be driven by a motor. The lay shaft 24 within the gear box 10 is driven by the drive shaft 22 by way of gears 23,25 which assist the shaft 22,24 in maintaining the rotors 15,16 at a similar angular speed so that the rotors 15,16 can effectively pump a desired substance by way of the interlocking or meshing action between the rotors 15,16 to turn similar speeds and preferably maintain a relative phase angle during such rotation. Seals 27 and/or 29 relative to the gear box 10, rotor housing 12, shafts 22,24 separate material pumped in cavity 14 from the gear box 10.

The shafts 22,24 may be journaled in the gear box 10 to front and rear bearings 31,33 to allow the shafts 22,24 to rotate in the gear box 10. The front bearings may be provided close to the rotor housing 12 so that the rotors 15,16 mounted toward the front end of the shafts 22,24 may respectively resist unacceptable displacement when subjected to various forces encountered during pumping. Rotor housing 12 has an inlet port 26 and an outlet port 28 which is in communication with the cavity 14. Rotation of the rotors 15,16 causes the substance to enter the rotary pump 8 by way of the input port 26 to then flow in the direction of the arrow 30 and exit the pump through the outlet 28. Of course the rotary pump 8 is reversible and the opposite direction can be obtained by reversing the rotation of the drive shaft 22.

Figure 2:
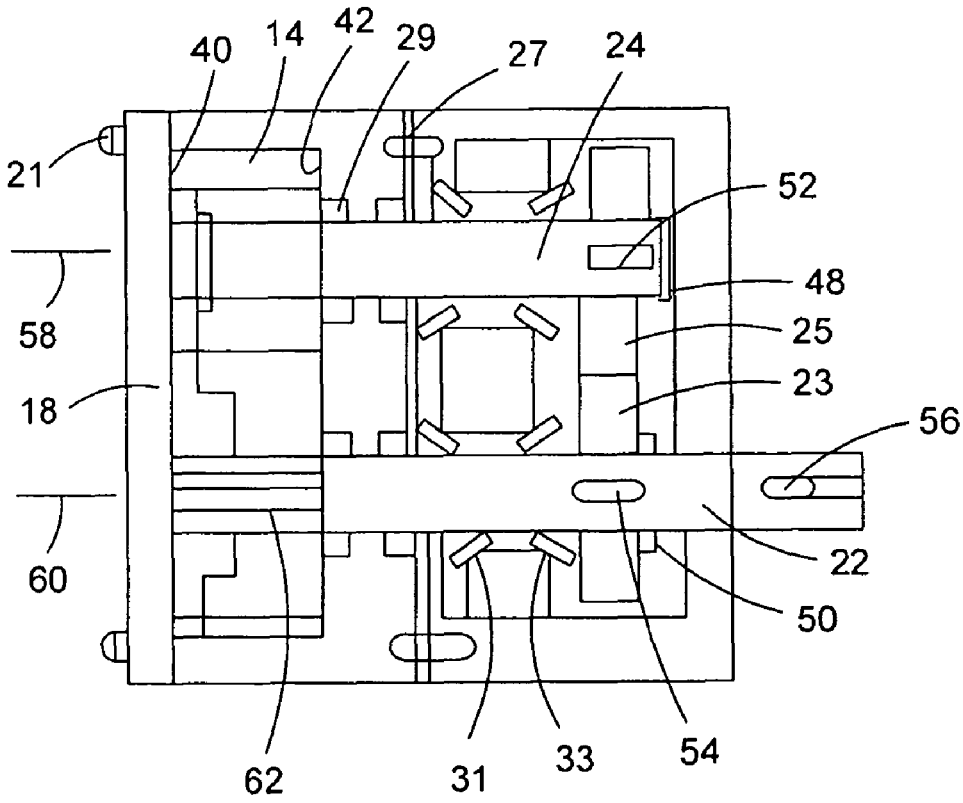
FIG. 2 is a side cross-sectional schematic view of the pump shown in FIG. 1 with the cover plate installed.

As the rotors 15,16 rotate, depending on whether or not they are locked to the shafts 22,24, they may come in contact with the rear 40 of the cover plate 18 or with the end wall 42 which assists in defining the cavity 14 as shown in FIG. 2. The rotors 15,16 may be locked to shafts 22,24 such as with rotor bolts 44,46 and/or shaft nuts 48,50. Keys 52,54 may also be utilized to assist in such endeavors and key 56 may be utilized to assist in locking key shaft 22 to a motor (not shown).

Figure 3:
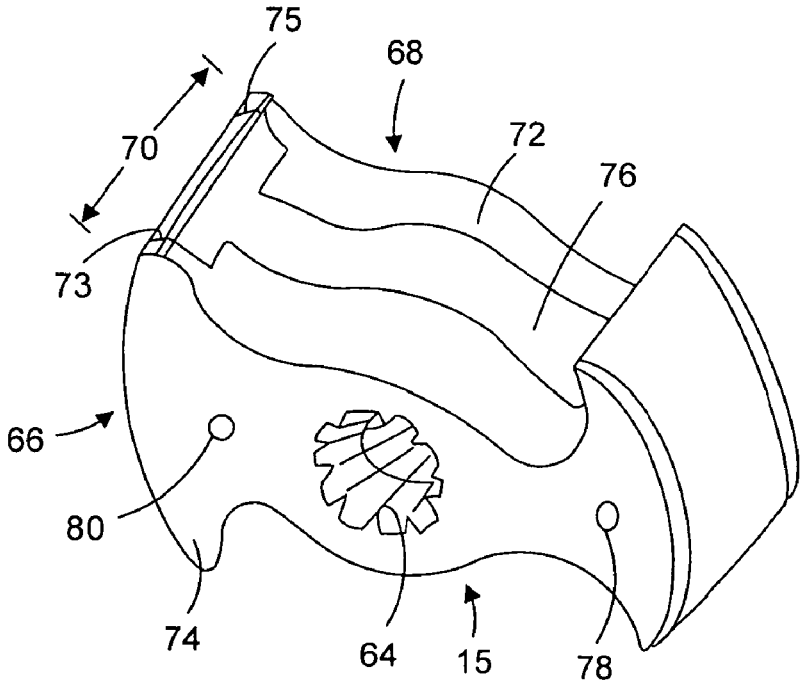
FIG. 3 is a top perspective view of a first preferred embodiment of a rotor construction in accordance with the presently preferred embodiment as shown utilized in the embodiments of FIGS. 1 and 2.

In at least some embodiments, the rotors 14,16 may not be secured in at least one direction along shaft axes 58,60 while being operably coupled to the shafts 22,24. Shaft axes 58,60 are illustrated parallel to one another. Shaft splines 62 may be provided which could be a male or female spline which cooperate with the other of the male or female splines 64. Rotor 15 as shown in FIG. 3 is removed from the constructions of FIG. 1 and FIG. 2. The spline 64 is shown extending intermediate first face 66 to second face 68 spanning width 70 internal to rotor 15. This may not be the case in all embodiments. Furthermore, the rotor 15,16 could be keyed or otherwise securely connected to the respective shafts 22,24 in other embodiments. By not securing the rotors 15,16 to the shafts 22,24 in the direction of the axes 58,60, they are particularly easy for an operator to remove for clean in place (CIP) operations. Specifically, they can be easily removed when the cover plate 18 is removed. However, one obvious worry that might come into play whether or not the rotors 14,15 are secured with the shafts 22,24 in the direction of the axes 58,60 respectively is the wear on the faces 66,68 against the rear 40 of the casing 18 or the end wall 42 of the rotor housing 12. In particular, the galling of steel on steel contact and/or unacceptable wear is best avoided and/or addressed.

Accordingly, the applicant is providing a pump 8 with improved rotor construction having rotor pads 72,74 connected to central member 76 connected at interfaces 73,75. Bores 78,80 are illustrated through which connectors may be extend therethrough to securely connect the pads 72,74 to central member 76. This provides a somewhat of a sandwich style construction which will be described in further detail below.

Figure 4:
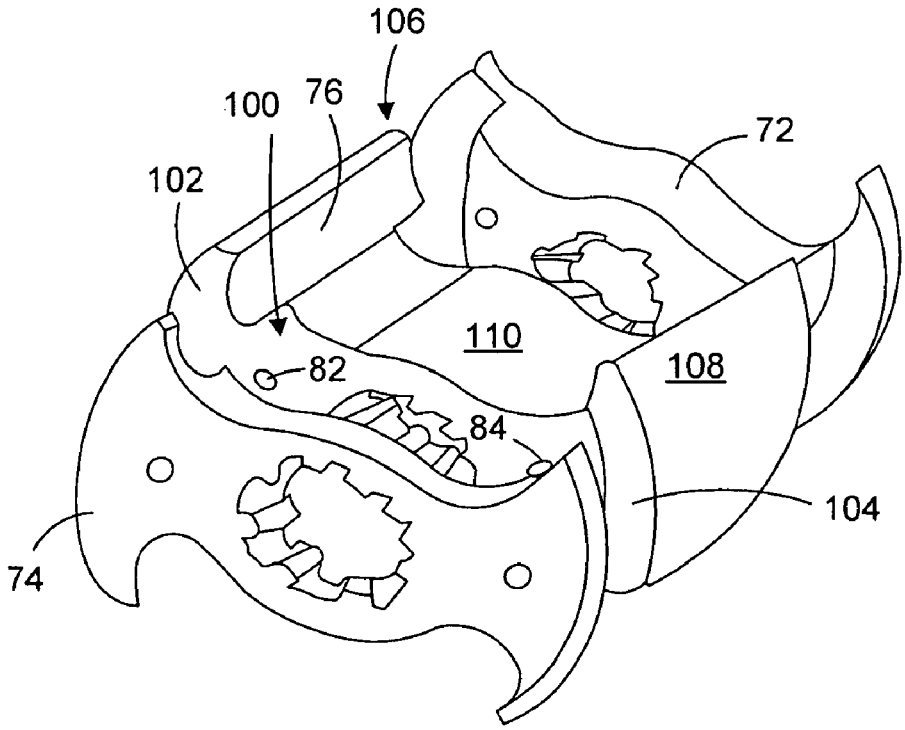
FIG. 4 is an exploded view of the rotor construction shown in FIG. 3.
Figure 5:
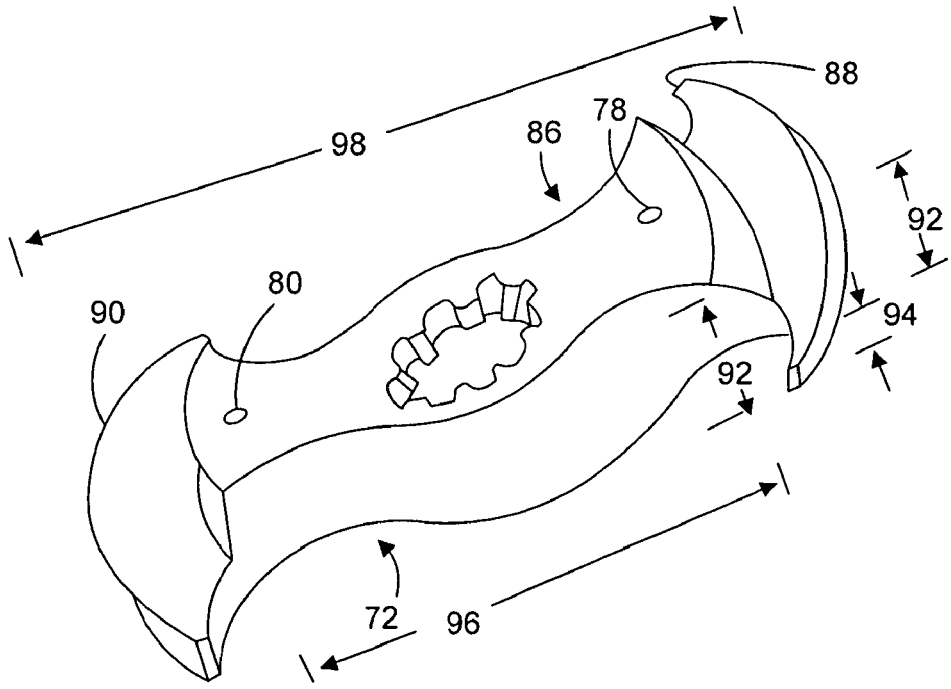
FIG. 5 is a bottom perspective view of a rotor pad shown in FIGS. 1-4.

The rotor pads 72,74 shown in FIG. 3 are shown in an exploded view in FIG. 4 with bores 82,84 which cooperate with bores 78,80 in support member or central member 76. A variety of connectors, including bolts, dowel connections, or other connectors may assist in making the connection. If pads 72,74 wear out, they can be relatively easily replaced while maintaining the support member 76. Additionally, pads 72,74 can have different properties than central member 76 such as anti-galling surfaces and/or anti-friction surfaces such as having a fluorine containing polymer, one of which is marked as Teflon® as marketed by the DuPont Company. High density polyethylene (HDPE) may also be utilized. In some applications, still other materials may be utilized. Interfaces 73,75 separate pads 72,74 from central support 76.

Rotor pads 72 is illustrated relative to the central member 76 and is preferably comprised of body 86 with shoulders 88 and 90 extending therefrom. In some embodiments it may be possible to form central member 76 with shoulders 88,90 are connected thereto, possibly without a body 86 forming a portion of pad 72. Bores 78,80 would likely then be located on the shoulders instead of body 86. Bores 78,80 as well as other connection mechanisms could also be utilized.

The body is illustrated as having a thickness or height 92 of at least about twice the thickness or height 94 of shoulder 88 or 90 and more preferably height 92 is preferably about at least three times as high as height 94. Accordingly, there are at least two thicknesses with a thickness greater towards the axis of rotation than of at a radial extreme (i.e., at an end of the shoulder as illustrated). Body 86 also has a length 96 which is a significant length relative to the length 98 of the rotor pad 72. In fact, as illustrated, the length 96 is illustrated at about 75% of the length of the overall length 98. While providing an aesthetically pleasing look is also one object of this construction, it has also been found satisfactory distribute the forces relative to shoulders 88,90. It may be possible in other embodiments for body length 96 to be smaller than 75% of the rotor pad length 98. Central member 76 is provided with a cut out 100 which receives a significant portion of body 96 while allowing the shoulders 88,90 to extend over the extensions 102,104. Central member 76 is viewed side 106 (i.e., parallel to axis 60 and extending through a rotor lobe) has a T-shaped cross section which is believed to assist in providing beneficial sealing as it relates to arcuate side walls 108. It is observed that shoulders 88,90 extend the thickness 70 of the rotor 15 by the height 94 of the shoulders 88,90 which in the preferred embodiment is consistent with the total rotor thickness 70 which is the sum of the body heights 92 of the rotor pads 72,74 as well as the thickness of the hub 110 illustrated in FIG. 4 of the central portion 76. Pads 72,74 may or may not be interchangeable with each other.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A rotary lobe pump comprising:

a rotor housing defining a cavity intermediate side walls, an end wall and a cover plate in the rotor housing;

inlet and outlet ports communicating with the cavity through the side walls;

a pair of rotors rotatably mounted in a rotor chamber and having parallel axes of rotation, said rotors having a first end directed towards one of the end wall and the cover plate;

said rotor having at least a first rotor pad extending from a support member towards the one of the end wall and the cover plate with at least a portion of the first rotor pad spacing the support member from the one of the end wall and the cover plate by about a thickness of the portion of the first rotor pad, and an interface being formed intermediate the support member and the rotor pad.

2. The rotary lobe pump of claim 1 wherein the first rotor pad has first and second thicknesses along a length of the rotor pad, the first thickness being greater than the second thickness.

3. The rotary lobe pump of claim 2 wherein a first thickness of the first rotor pad measured closer to one of the axes of rotation is greater than a second thickness as measured at a radial extreme relative to the one of the axes of rotation.

4. The rotary lobe pump of claim 1 further comprising shafts along the axes of rotation and wherein the rotors are operably coupled to the shafts for rotation with the shafts, but are not rigidly secured to the shaft to prevent movement along the axes of rotation at least in one direction.

5. The rotary lobe pump of claim 4 wherein the rotors are retained to the shafts by splines.

6. The rotary lobe pump of claim 1 further comprising a second rotor pad opposite the support member from the first rotor pad, with the first and second rotor pads facing the end wall and the cover plate.

7. The rotary lobe pump of claim 6 wherein the first and second rotor pads are interchangeable with one another.

8. The rotary lobe pump of claim 6 wherein the support member has a T shaped configuration cross section as taken along a plane extending parallel to the axis of rotation through a lobe of the support member.

9. The rotary lobe pump of claim 1 wherein the first rotor pad provides at least one of less friction than the support member and less tendency to gall than the support member.

10. The rotary lobe pump of claim 1 wherein the first rotor pad and support member each have at least one bore and a connector extends through the at least one bores retaining the first rotor pad to the support member.

11. The rotary lobe pump of claim 10 wherein the first rotor pad has shoulders extending from a base, said base being closer to the axis of rotation than the shoulders, and the shoulders having a thickness of less than half of the thickness of the base, and the at least one bore of the first rotor pad extends through the base.

12. A positive displacement pump comprising:

a rotor housing defining a cavity intermediate side walls, an end wall and a cover plate in the rotor housing;

inlet and outlet ports communicating with the cavity through the side walls;

a pair of rotors rotatably coopering in the rotor chamber to pump material from the inlet port to the outlet port, said rotors having parallel axes of rotation along shafts, said rotors having a first end directed towards one of the end wall and the cover plate;

said rotor having at least a first rotor pad extending from a support member towards the one of the end wall and the cover plate, and said rotors being operably coupled to the shaft for rotation with the shaft while not being directly secured to the shaft thereby allowing movement in at least one direction along the axis of rotation during pump operation.

13. The positive displacement pump of claim 12 wherein at least a portion of the first rotor pad spaces the support member from the one of the end wall and the cover plate, and an interface is formed intermediate the support member and the rotor pad.

14. The positive displacement pump of claim 13 wherein the first rotor pad has first and second thicknesses along a length of the rotor pad, the first thickness being greater than the second thickness.

15. The positive displacement pump of claim 14 wherein a first thickness of the first rotor pad measured closer to one of the axes of rotation is greater than a second thickness as measured at a radial extreme relative to the one of the axes of rotation.

16. The positive displacement pump of claim 12 wherein the rotors are connected to the shafts with splines.

17. The positive displacement pump of claim 12 further comprising a second rotor pad opposite the support member from the first rotor pad, with the first and second rotor pads facing the end wall and the cover plate.

18. The positive displacement pump of claim 17 wherein the support member has a T shaped configuration cross section as taken along a plane extending parallel to the axis of rotation through a lobe of the support member.

19. The positive displacement pump of claim 17 wherein the pump is a lobe pump.

* * * * *